US008726953B2

(12) United States Patent
Paulsen

(10) Patent No.: US 8,726,953 B2
(45) Date of Patent: May 20, 2014

(54) CARD RETRIEVER FOR RETRIEVING SMALL CARD-LIKE OBJECTS FROM A WALLET

(76) Inventor: Kathie Paulsen, Burbank, CA (US)

( * ) Notice: Subject to any disclaimer, the term of this patent is extended or adjusted under 35 U.S.C. 154(b) by 351 days.

(21) Appl. No.: 12/984,192

(22) Filed: Jan. 4, 2011

(65) Prior Publication Data

US 2011/0162766 A1 Jul. 7, 2011

Related U.S. Application Data

(60) Provisional application No. 61/292,013, filed on Jan. 4, 2010.

(51) Int. Cl.
*A45C 1/06* (2006.01)

(52) U.S. Cl.
USPC ..... 150/147; 150/131; 150/134; 150/137; 150/148; 150/149; 224/268; 224/267; 224/270; 224/667; 24/16 R; 24/17 B

(58) Field of Classification Search
USPC ..... 150/147, 131, 134, 137, 148, 149; 224/268, 267, 270; 24/16 R, 17 B, 17 R, 24/3.11, 3.12, 67.9
See application file for complete search history.

(56) References Cited

U.S. PATENT DOCUMENTS

| | | | | |
|---|---|---|---|---|
| D551,446 | S * | 9/2007 | Elnekaveh | D3/249 |
| 7,331,366 | B1 * | 2/2008 | Patterson | 150/149 |
| 7,448,155 | B2 * | 11/2008 | Dolas | 40/659 |
| 7,640,632 | B2 * | 1/2010 | Lazarus | 24/17 B |
| 2007/0145208 | A1 * | 6/2007 | Beaver | 248/175 |
| 2009/0211062 | A1 * | 8/2009 | Preston-Hall | 24/17 B |
| 2010/0078101 | A1 * | 4/2010 | Styron et al. | 150/137 |

* cited by examiner

*Primary Examiner* — Anthony Stashick
*Assistant Examiner* — Cynthia Collado
(74) *Attorney, Agent, or Firm* — James A. Italia; Italia IP

(57) ABSTRACT

A device for extracting a card such as a credit card from a wallet. The device may comprise a pulling hook formed from relatively thin material, a handle for grasping, and a strap connecting the handle to the pulling hook. The handle may be configured as a T-handle. The strap may bear adhesive to discourage the card from sliding along the length of the strap. The device may have a pushing hook opening in a direction opposite that of the pulling hook, such that the card may be inserted between and engage the pushing hook and the pulling hook and be entrapped therebetween. The hook may have sufficient overall length to project outside a pocket into which the card has been stored and in which the card is fully contained.

6 Claims, 3 Drawing Sheets

CARD RETRIEVER FOR RETRIEVING SMALL CARD-LIKE OBJECTS FROM A WALLET

CROSS REFERENCE TO RELATED APPLICATION

This application claims priority from U.S. Provisional Application No. 61/292,013, entitled "CARD RETRIEVER FOR RETRIEVING SMALL CARD-LIKE OBJECTS FROM A WALLET", filed on Jan. 4, 2010. The entire contents and disclosures of forgoing application are herby incorporated by reference.

FIELD OF THE INVENTION

The present invention relates to a retriever for withdrawing small cards such as credit cards, driver's licenses, library cards, access cards, and the like from a wallet or other storage receptacle.

BACKGROUND OF THE INVENTION

People usually carry small cards such as credit and debit cards, driver's licenses, library cards, voter registration cards, access cards, parking authorization cards and the like in wallets. Such cards have become ubiquitous due to their practicality and low cost. These cards have become somewhat standardized in their dimensions and configuration, notably being of dimensions and configuration which fit easily into wallets, and particularly into individual pockets typically formed in wallets. Because these cards have come into widespread use for diverse purposes, one person typically acquires a number of such cards. When it is time to use any one card, that card is retrieved from the wallet and used.

Retrieving a card from a wallet is something which may be regarded as effortlessly and automatically performed. Most people give no thought to this and take the action of retrieving a card from a wallet for granted. However, some people suffer from disabling conditions which make the act of extracting a card from a wallet difficult. For example, arthritis, temporary injury, and other conditions can make it extremely difficult to perform the act of grasping a card and removing that card from a wallet.

There exists a need for a device which renders it easy for a person having a disabling condition which interferes with grasping and pulling a card from a wallet to be able to readily grasp and retrieve the card.

SUMMARY OF THE INVENTION

The present invention provides a device which meets the above stated need. The device comprises a handle to enable ready grasping by hand, and a hook for engaging a card placed in a wallet. The device is dimensioned and configured to project beyond a card, and outside of a pocket of a wallet, so that that the handle is readily accessible. The user need only grasp the exposed handle of the device and pull the same upwardly. Because the hook engages the card by interference, little if any effort need be exerted to extract the card from the wallet despite frictional and other resistance forces which may oppose removal of the card. This greatly reduces necessary manual effort which may then be at levels which can be exerted even by someone suffering from a degree of disablement.

The novel device may comprise a second projection or hook which when taken in combination with the first hook engages the card at opposing sides. This enables the device to assist in urging the card back into the wallet when the card is being replaced after use. The novel device may include friction enhancing material instead of or in addition to the second hook to discourage casual unintended loss or disengagement of the card from the device.

It is therefore an object of the invention to enhance ability of a person suffering from disablement to grasp and retrieve a card from a wallet.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
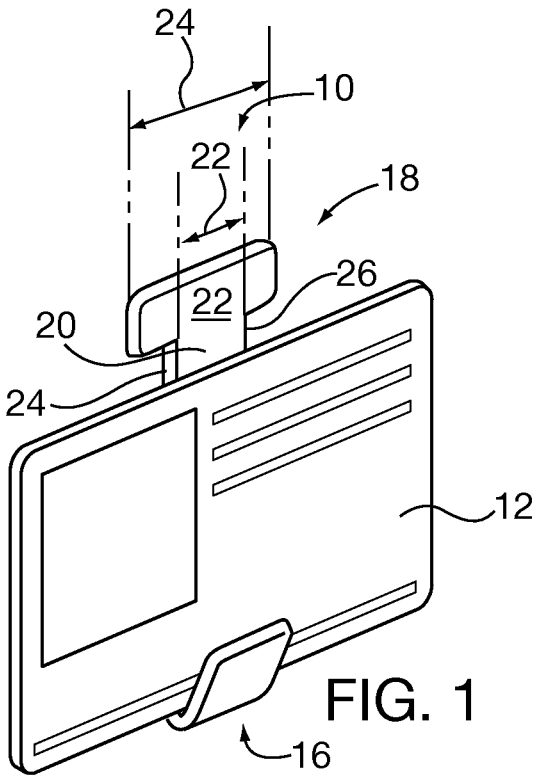
FIG. 1 is an environmental perspective view of a device for retrieving a card from a wallet according to at least one aspect of the invention.
Figure 2:
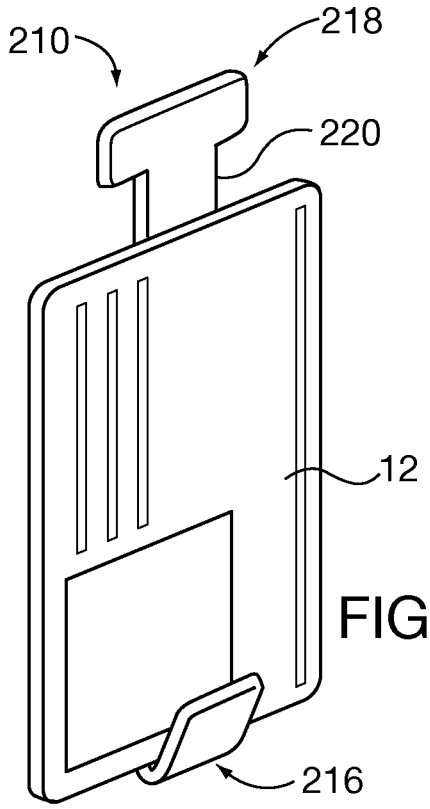
FIG. 2 is similar to FIG. 1, but shows a device of greater overall length.

Referring first to FIG. 1, according to at least one aspect of the invention, a device 10 for retrieving a card such as a driver's license 12 from a wallet (such as the wallet 14 shown in FIG. 6) is seen to comprise a pulling hook 16 for engaging an edge of the driver's license 12, a handle 18 for grasping by a person, and a strap 20 disposed to connect the pulling hook 16 to the handle 18. The handle 18 may be a T-handle. Alternatively stated, the handle 18 may comprise a member 22 projecting in the width direction beyond two sides 24, 26 of the strap 20.

The device 10 may be fabricated from a relatively thin flat substrate such that the pulling hook 16, the handle 18, and the strap 20 are all of equal thickness. This is best seen in the end view of FIG. 3. The handle 18 and the strap 20 occupy a common plane. The pulling hook 16 deviates from the strap 20 in a direction out of the common plane occupied by the handle 18 and the strap 20.

The device 10 may be configured such that the pulling hook 16, the strap 20, and the handle 18 each have width less than that of the driver's license 12. Width is indicated by arrows in FIG. 1, the width of the strap 20 and of the pulling hook 16 being indicated by an arrow 22, and the width of the handle 18 being indicated by an arrow 24. It should be noted that because the overall width of the device 10 may be limited such that the card engaged and made removable thereby may vary in size. Alternatively stated, the device 10 and its variants as described hereinafter may accommodate cards of different sizes, although it is recognized that most cards such as driver's licenses, credit and debit cards, and others are generally fabricated to certain standard sizes or dimensions.

A friction enhancement may be disposed on the device 10 to engage the driver's license 12 and to oppose sliding of the driver's license along the strap 20. The friction enhancement may comprise a relatively high friction coating such as adhesive 28 (see FIG. 4) disposed on the strap. The adhesive 28 is of a type which will not ordinarily transfer to the card due to contact therewith. Other friction coatings such as rubber (not shown) may be employed as a friction enhancement rather than the adhesive 28. Another form of friction enhancement which may be employed is to form the interior 30 of the hook 16 to be so pointed as to entrap the driver's license 12 by friction when the driver's license 12 is forced into the interior 30 (see FIG. 3).

Figure 5:
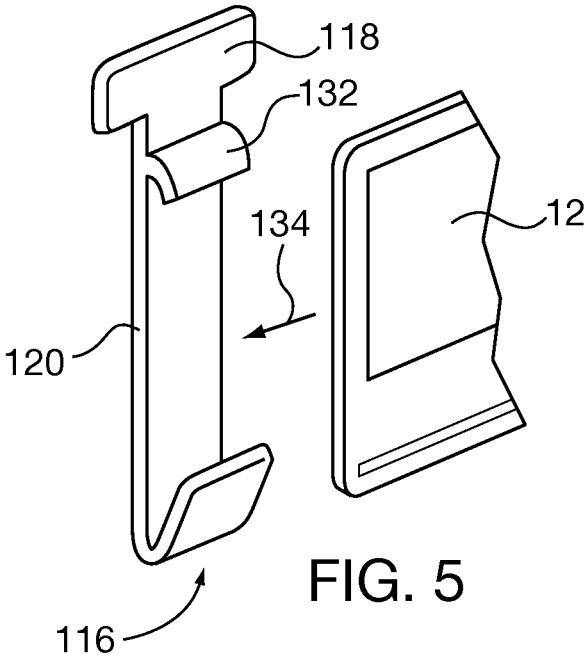
FIG. 5 is an exploded environmental view of another device for retrieving a card from a wallet according to a further aspect of the invention.

Referring now to FIG. 5, a device 110 for retrieving a card from a wallet may according to a further aspect of the invention comprise, in addition to a pulling hook 116 for engaging an edge of the card such as the driver's license 12, a handle 118 for grasping by a person, and a strap 120 disposed to connect the pulling hook 116 to the handle 118, a pushing hook 132 projecting from the strap 120 between the pulling hook 116 and the handle 118. The pushing hook 132 and the pulling hook 116 open in opposed directions such that the card may be slid into engagement with both the pushing hook 132 and the pulling hook 116 when slid in the direction of the arrow 134. It will be appreciated that when so entrapped between the pushing hook 132 and the pulling hook 116, the card may be pulled upwardly, as would occur typically when retrieving the card from a wallet, and may be pushed downwardly, as would occur typically when reinserting the card in the wallet, without significant risk of dislodging of the card from entrapment.

Figure 6:
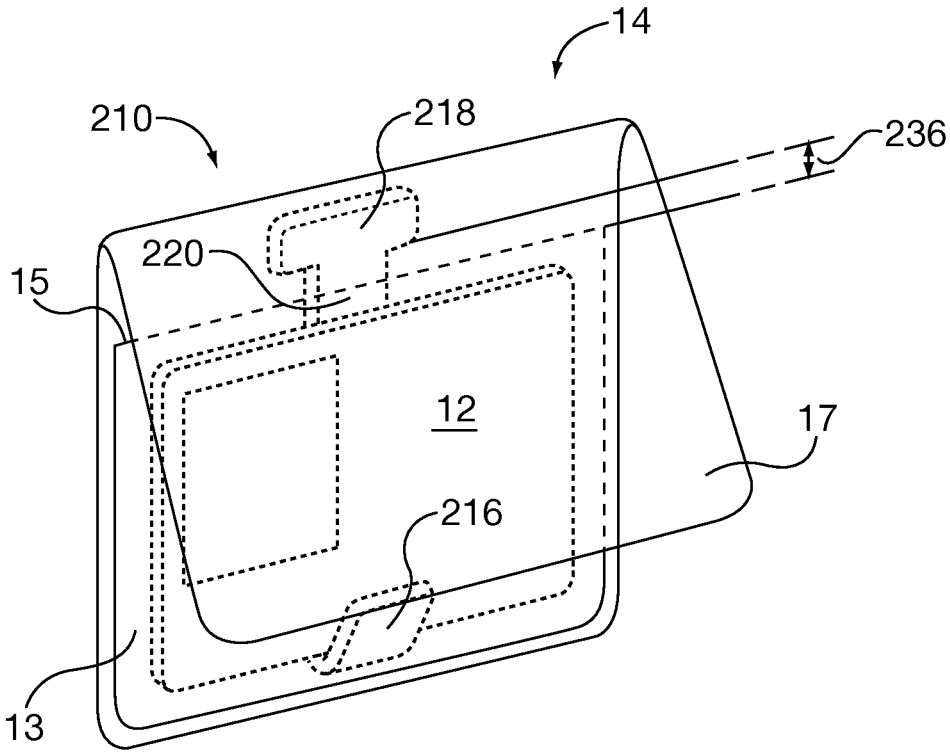
FIG. 6 is an environmental perspective view of a card mounted to a device according to at least one aspect of the invention, with the card and device placed in a wallet.

Turning now to FIG. 6, the driver's license 12 is shown inserted into a pocket 13 of a wallet 14. A device 210 for retrieving a card such as the driver's license 12 from the wallet 14 may according to a further aspect of the invention comprise, in addition to a pulling hook 216 for engaging an edge of the card, a handle 218 for grasping by a person, and a strap 220 disposed to connect the pulling hook 216 to the handle 218. The strap 220 is greater in length than the strap 20 of FIG. 1, so that the over all length of the device 210 is such that the handle 218 is spaced apart from the pulling hook 216 a sufficient distance to project for finger access from the pocket 13 into which the card has been fully inserted, even if the card is at the point of total containment within the pocket 13. More specifically, the strap 220 is long enough so that the bottom of the handle 218 projects beyond the top 15 of the pocket 13 to afford ready access when the flap 17 of the wallet 14 is lifted to expose the handle 218. A gap 236 is defined between the bottom of the handle 218 and the top 15 of the pocket 13 even when the device 210 is pushed downwardly within the pocket 13 such that the hook 216 abuts the bottom of the pocket 13.

The present invention is susceptible to modifications and variations which may be introduced thereto without departing from the inventive concepts. For example, a handle such as the handle 18 need not be a T-handle. The handle may comprise one laterally projecting member rather than the two opposed laterally projecting members which define a T-handle.

Figure 3:
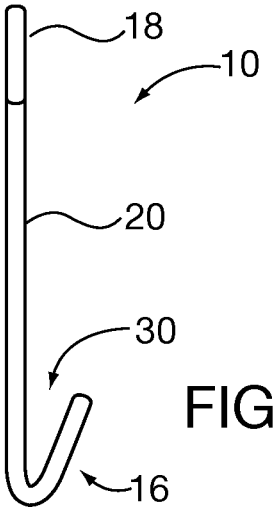
FIG. 3 is an end view of the device of FIG. 1.
Figure 4:
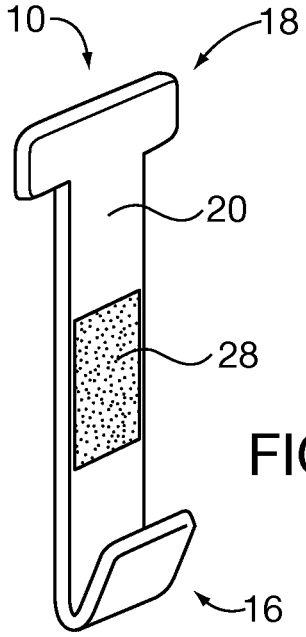
FIG. 4 is a perspective view of the device of FIG. 1.

Other variations may also be provided. For example, FIGS. 1, 3, and 4 show a device 10 having a single hook (i.e., the pulling hook 16 and being of a certain overall length, where the length refers to the maximum span from the handle 18 to the hook 16. The device 110 may be generally similar to the device 10, but differing in having the pushing hook 132. These two varieties may be repeated but with greater overall length. The device 210 is similar to the device 10, but is of greater overall length. A device similar to the device 110 but having greater overall length, such as having the length of the device 210, may also be provided (this embodiment is not shown). Any of these embodiments may be further varied to include a friction enhancement as described above. Any of these embodiments may be varied as to configuration of the handle, such as the handle 18, or as to the hook, such as the hook 16.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A device for retrieving a card from a wallet, comprising:

a pulling hook for engaging an edge of the card, wherein the pulling hook has a width, a handle for grasping by a person, wherein the handle has a width; and a strap disposed to connect the pulling hook to the handle; wherein the pulling hook has a width less than that of the card, the strap has a width less than that of the card, and the width of the handle has width greater than that of the strap and less than that of the card, wherein the device remains in the wallet and engaged to said edge of said card when said wallet is closed.

2. The device of claim 1, wherein the pulling hook, the handle, and the strap are all of equal thickness.

3. The device of claim 1, wherein the handle comprises a member projecting in the width direction beyond two sides of the strap.

4. The device of claim 1, wherein the handle and the strap occupy a common plane, and the pulling hook deviates from the strap in a direction out of the common plane occupied by the handle and the strap.

5. The device of claim 1, wherein the handle is spaced apart from the pulling hook a sufficient distance to project for finger access from a pocket into which the card has been fully inserted to the point of total containment of the card within the pocket.

6. A card such as a credit card or a driver's license, and a device for retrieving the card from a wallet, comprising:

a device comprising a pulling hook for engaging an edge of the card, wherein the pulling hook has a width, a handle for grasping by a person, wherein the handle has a width; and a strap disposed to connect the pulling hook to the handle; and wherein the pulling hook has width less than that of the card, the strap has a width less than that of the card, and the width of the handle has width greater than that of the strap and less than that of the card; and a card of standard size and dimension of credit cards and driver's licenses, wherein the pulling hook, the strap, and the handle each have width less than that of the card, wherein the device remains in the wallet and engaged to said edge of said card when said wallet is closed.

* * * * *